United States Patent [19]

Lorenz

[11] 4,107,029

[45] Aug. 15, 1978

[54] DUAL CONTROL SYSTEM FOR TAILINGS OUTLET OF PRIMARY SEPARATION VESSEL IN THE HOT WATER PROCESS FOR BITUMINUOUS SANDS

[75] Inventor: Gordon Ronald Lorenz, Edmonton, Canada

[73] Assignees: Her Majesty the Queen in right of Canada, as represented by the Minister of Energy, Mines and Resources, Ottawa; Her Majesty the Queen in right of the Province of Alberta, Government of the Province of Alberta, Department of Energy and Natural Resources, Alberta Syncrude Equity, Edmonton; Ontario Energy Corporation; Imperial Oil Limited, both of Toronto; Canada-Cities Service, Ltd., Calgary; Gulf Oil Canada Limited, Toronto, all of Canada

[21] Appl. No.: 762,776

[22] Filed: Jan. 25, 1977

[30] Foreign Application Priority Data

Apr. 27, 1976 [CA] Canada ..... 251142

[51] Int. Cl.[2] ..... C10G 1/04

[52] U.S. Cl. ..... 208/11 LE; 196/14.52

[58] Field of Search ..... 208/11 LE

[56] References Cited

U.S. PATENT DOCUMENTS

| | | | |
|---|---|---|---|
| 3,530,041 | 9/1970 | Erskine et al. | 208/11 LE |
| 3,530,042 | 9/1970 | Graybill et al. | 208/11 LE |
| 3,619,406 | 11/1971 | Bowman et al. | 208/11 LE |

*Primary Examiner*—Herbert Levine
*Attorney, Agent, or Firm*—E. P. Johnson

[57] ABSTRACT

It has been found that controlling the rate of withdrawal of tailings from a hot water process primary separation vessel with a rake torque sensor is attended by problems when the feed to the vessel is high in fine solids content. It was also found that a nuclear density gauge was much better at controlling the withdrawal with the high fines feed, but did not work as well as rake torque control with low fines feed. Therefore the withdrawal is now controlled with a rake torque sensor when the vessel is receiving low fines feed and a density gauge when it is receiving high fines feed.

1 Claim, 1 Drawing Figure

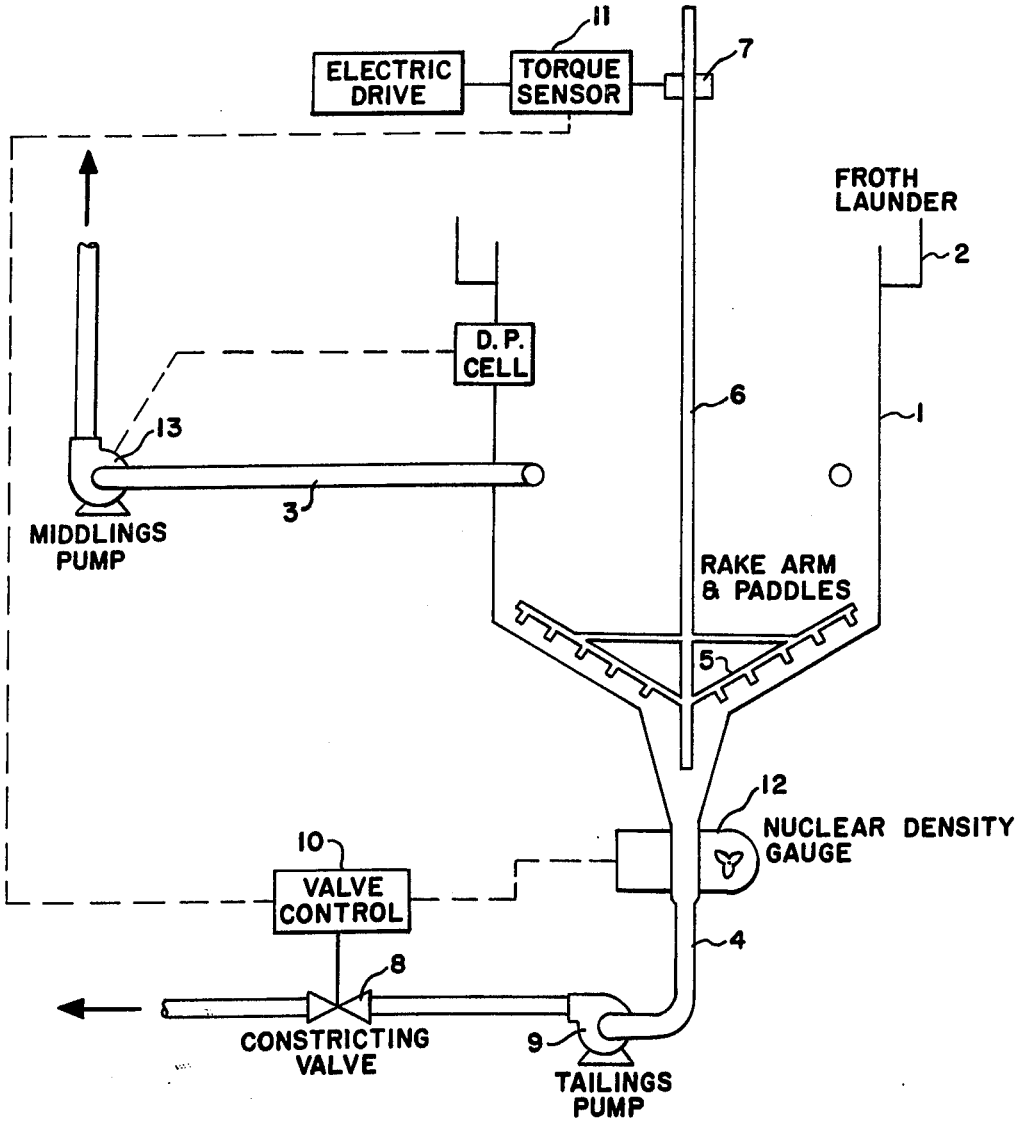
11
ELECTRIC DRIVE
TORQUE SENSOR
7
FROTH LAUNDER
2
D. P. CELL
6
1
13
3
MIDDLINGS PUMP
RAKE ARM & PADDLES
5
12
NUCLEAR DENSITY GAUGE
10
VALVE CONTROL
4
8
CONSTRICTING VALVE
9
TAILINGS PUMP

DUAL CONTROL SYSTEM FOR TAILINGS OUTLET OF PRIMARY SEPARATION VESSEL IN THE HOT WATER PROCESS FOR BITUMINUOUS SANDS

BACKGROUND OF THE INVENTION

This invention relates to the hot water process for extracting bitumen from bituminous sands. More particularly it relates to a method of controlling the rate of tailings withdrawal through the outlet of the primary separation vessel used in the process.

A large proportion of the world's known hydrocarbon reserves exists in the form of bituminous sands. One large deposit of this material is found along the banks of the Athabasca River in Alberta. It exists in the form of waterwet grains of sand, sheathed in a film of bitumen. In treating the sands to recover commercially useful products, it is first necessary to separate the bitumen from the water and solids.

The method presently employed to extract the bitumen from the mined sands is known as the hot water process. In the first step of this process, bituminous sands, hot water, a minor amount of a dispersant, such as NaOH, and steam are fed into a rotating tumbler and mixed therein. The hot water is supplied at a temperature of about 180° F and in amounts sufficient to supply a slurry containing about 20 - 25% by weight water. The dispersant is typically provided in an amount of 0.025% by weight of tar sand. The residence time within the tumbler is nominally four minutes and the exit temperature of the slurry is about 180° F. While in the tumbler, the tar sand disintegrates and the bitumen particles are liberated from the sand.

The tumbler product is passed through a screen to remove lumps and rocks and is then flooded with additional hot water to further disperse the sand and bitumen particles. A typical flooded slurry will have a composition of 7% bitumen, 43% water and 50% solids, and its temperature will be about 160° F - 180° F.

The flooded slurry is then continuously fed into a primary separation vessel. This vessel is conventionally a cylindrical settler having a conical bottom. In the vessel, most of the large sand particles (i.e. plus 200 mesh) fall to the bottom and leave through an outlet as a primary tailings stream. Most of the bitumen particles rise to the top of the vessel and form primary bitumen froth. This froth overflows the vessel wall into a launder for removal. A middlings stream, typically comprising about 77% water, 21% solids and 2% bitumen, is continuously withdrawn from the intermediate zone of the primary vessel. The middlings stream is processed in a sub-aerated secondary recovery flotation cell to produce secondary froth and a secondary tailings stream.

For purposes of this specification, "fine solids" is understood to mean −325 mesh particulate matter.

The fine solids content of bituminous sands varies widely. For example, in a regular or "low fines" bituminous sand, less than about 15% by weight of the total solids are fine solids while in a "high fines" bituminous sand, greater than about 20% of the total solids are fine solids.

Heretofore it has been known that high fines sands are difficult to treat in the hot water process and yield relatively poor bitumen recoveries.

At this point it is useful to digress and review how the primary separation vessel is operated in accordance with the prior art. The bituminous sands slurry is usually fed to the vessel at a generally constant rate, although, of course, its composition varies since the sands themselves vary in composition. Three product streams are produced from the vessel. The first of these is the froth product, which overflows the vessel rim and drops into a circumferential launder. The second is the middlings stream which is withdrawn by a variable-speed pump and is pumped to the secondary recovery cell. The level of the froth-middlings interface is monitored by a sensing device and the rate of middlings withdrawal is controlled in response to this measurement with the aim of keeping the position of the interface constant. The third product is the tailings stream. Its rate of withdrawal is controlled by throttling means, such as a valve or variable-speed pump, in the outlet line. The operation of the throttling means is regulated by a torque-sensing device which measures the torque generated in the shaft of the vessel's sand rake. The torque measurement is assumed to be related to the position of the surface of the sand bed within the vessel. More particularly, as the sand bed builds up, it begins to cover the rake, thereby increasing the torque developed in the rake shaft. Now, the throttling means are operated to maintain a sand seal at the outlet and to maintain the tailings as dry as possible (i.e. in the order of 70% solids) to minimize oil losses with the tailings.

As the composition of the tar sand slurry entering the vessel varies, it is necessary to manipulate the throttling means on the middlings and tailings lines to keep the froth-middlings and middlings-sand interfaces positioned at pre-determined desirable levels.

When working with low fines feed, the torque-sensing system works satisfactorily. The sand bed seems to be well-defined and its dragging effect on the sand rake varies directly with the extent to which the prongs of the rake are buried in it.

As previously pointed out, however, when the vessel is fed high fines slurry feed, difficulties arise. It appears that a sand bed having a firm upper layer is not developed. Thus the position of the bed surface is not accurately indicated by the torque-sensing device mounted on the rake shaft.

In practice, one finds that the rake torque measurement remains generally low for a period of time as high fines slurry feed is processed in the vessel. As a result, the throttling means on the tailings outlet is kept in a constrictive condition. Suddenly, however, the rake torque increases dramatically, indicating that the rake has become buried to a substantial extent. When this occurs, the tailings outlet throttling means is adjusted and tailings are withdrawn at a rapid rate. This causes the froth-middlings interface to drop, thereby triggering constrictive adjustment of the middlings line throttling means. After a quantity of tailings has been removed, the rake torque drops off quickly and the tailings throttling means sharply reduces tailings withdrawal. In order to maintain the froth-middlings interface at the desired level, middlings withdrawal is then accelerated. "Short circuiting" of the vessel operation may occur, as bitumen is drawn out through the middlings line.

From the foregoing, it will be understood that provision of high fines slurry feed to a primary separation vessel, controlled in accordance with the prior art, leads to:

1. Unstable operation of the primary separation vessel and surging of froth and middlings product streams, which is undesirable as it affects the operations of downstream units;

2. Short-circuiting of the primary separation cell, with the result that a high proportion of the bitumen may be produced as secondary froth - this is undesirable as this froth is more heavily contaminated with solids than primary froth, due to the vigorous aeration which is practised in the secondary cell; and 3. Settling of solids in the middlings and tailings outlet lines during the periods when the throttling means controlling flow through those lines are constricted, which can lead to plugging of the lines.

SUMMARY OF THE INVENTION

In accordance with the invention, the throttling means on the tailings outlet line is controlled by one of two systems, depending on the nature of the slurry feed being processed in the primary separation vessel. More particularly, during those periods when the vessel is processing low fines slurry, rake torque is monitored and used to control the throttling means. During those periods when high fines slurry is being processed, the density of the tailings stream is monitored and used to control the throttling means. As a result of practising this system, it has been found that recovery of bitumen from the primary separation vessel can be increased. It has also been found that the density system does not work as well as rake torque when the primary separation vessel is processing slurry from low fines sands. More particularly, the tailings pump tends to become plugged with solids when trying to control the tailings density to 70%, i.e. to the level which can be achieved with rake control.

As a result of the practice of the invention, the following advantages have been achieved.

(1) The operation of the primary separation vessel is better stabilized when processing high fines slurry feed; and (2) As a result of stabilization, short-circuiting of the vessel is reduced and it is found that a higher proportion of the bitumen is produced as primary froth than has heretofore been the case.

DESCRIPTION OF THE DRAWING

The attached drawing is a schematic showing a primary separation vessel equipped with means for measuring the density of the tailings stream and means for measuring the rake shaft torque.

DESCRIPTION OF THE PREFERRED EMBODIMENT

More particularly, with reference to the drawing, there is shown a primary separation vessel 1 having a launder 2 for removal of froth, a middlings conduit 3 for removal of middlings, and a tailings conduit 4 for removal of tailings. A rake 5, having a drive shaft 6, is centrally mounted in the vessel in conventional fashion. The rake is rotated by an electrically driven drive system 7.

The rate of withdrawal of tailings is controlled by a constricting valve 8 downstream of a constant speed tailings pump 9.

The constricting valve 8 is operated by a valve control 10 responsive to either a torque sensor 11, connected to the rake shaft 6, or a nuclear density gauge 12 attached to the tailings conduit 4. We have successfully used a torque sensor model 1104, available from Lebow Associates Inc., Troy, Michigan, and a density gauge available from Ohmart of Canada, Toronto, Ontario, for this purpose.

A variable speed pump 13, controlled by a differential pressure liquid-froth interface sensor, is used to withdraw middlings from the vessel to maintain the interface level generally constant.

The invention was developed as a result of observing the unstable operation and other previously described problems arising from feeding high fines feed to the vessel, and recognizing that the rake torque control was inaccurate in this environment. Experimentation showed that a nuclear density gauge could properly control the tailings withdrawal and that surprisingly improved bitumen recoveries are obtained by using the gauge on the high fines feed. This is demonstrated by the following table, showing the results obtained when bituminous sands from the same source were processed at the same process conditions.

Table I

| Samples processed with rake torque control: | | | |
|---|---|---|---|
| Bituminous Sands | | % Primary | % Combined |
| % Bitumen | % −325 | Recovery | Recovery |
| 6.4 | 25.8 | 24.5 | 83.3 |
| 6.9 | 19.7 | 12.1 | 66.0 |
| 7.0 | 26.2 | 12.2 | 71.5 |
| 6.5 | 24.9 | 14.0 | 77.7 |
| 7.8 | 19.2 | 19.0 | 63.5 |

| Samples processed with density gauge control: | | | |
|---|---|---|---|
| Bituminous Sands | | % Primary | % Combined |
| % Bitumen | % −325 | Recovery | Recovery |
| 7.7 | 19.5 | 64.4 | 87.1 |
| 8.7 | 16.6 | 33.8 | 83.6 |
| 9.0 | 12.8 | 44.2 | 85.1 |
| 7.8 | 14.7 | 48.9 | 88.4 |
| 8.6 | 15.4 | 41.0 | 85.1 |

In our experience, rake torque control on the tailings outlet of the primary separation vessel is the preferred operating mode for bituminous sands containing less than 15 to 20% of the total solids as fines.

The embodiments of the invention in which an exclusive property or privilege is claimed are defined as follows:

1. In the hot water process for recovering bitumen from bituminous sands which vary in fine solids content, wherein an aqueous slurry of the sands is fed to a primary separation vessel, said vessel having a sand rake rotated by a shaft and a tailings outlet controlled by throttling means, said vessel producing a bitumen froth stream, a tailings stream mainly comprising solids, and a middlings stream, the improvement comprising:

when the slurry feed to the vessel is formed from bituminous sands containing less than 15 - 20% by weight of the total solids as fine solids, controlling the throttling means to increase the tailings withdrawal rate in response to measurements indicative of an increase in the rake shaft torque; and when the slurry feed to the vessel is formed from bituminous sands containing more than 15 - 20% by weight of the total solids as fine solids, controlling the throttling means to increase the tailings withdrawal rate in response to measurements indicative of an increase in the density of the tailings stream, so that the tailings level within the vessel can be accurately monitored and the information acquired used to control the rate of withdrawal of the tailings to thereby optimize the composition of the tailings stream and stabilize the operation of the vessel.

* * * * *